US008747241B2

(12) United States Patent
Molinari

(10) Patent No.: US 8,747,241 B2
(45) Date of Patent: Jun. 10, 2014

(54) GOLF BALL WITH PIEZOELECTRIC MATERIAL

(75) Inventor: Arthur Molinari, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 533 days.

(21) Appl. No.: 12/722,984

(22) Filed: Mar. 12, 2010

(65) Prior Publication Data

US 2011/0224008 A1 Sep. 15, 2011

(51) Int. Cl.
*A63B 69/36* (2006.01)

(52) U.S. Cl.
USPC ..... 473/131

(58) Field of Classification Search
USPC ..... 473/200, 199, 131; 463/3
See application file for complete search history.

(56) References Cited

U.S. PATENT DOCUMENTS

| | | | | |
|---|---|---|---|---|
| 4,775,948 | A | 10/1988 | Dial et al. | |
| 5,351,952 | A | 10/1994 | Hackman | |
| 5,447,314 | A | 9/1995 | Yamazaki et al. | |
| 5,518,235 | A | 5/1996 | Mendenhall | |
| 5,788,178 | A * | 8/1998 | Barrett, Jr. | 244/3.11 |
| 6,073,086 | A | 6/2000 | Marinelli | |
| 6,113,504 | A | 9/2000 | Kuesters | |
| 6,148,271 | A | 11/2000 | Marinelli | |
| 6,157,898 | A | 12/2000 | Marinelli | |
| 6,196,932 | B1 | 3/2001 | Marsh et al. | |
| 6,565,449 | B2 | 5/2003 | Buhler | |
| 6,572,492 | B2 | 6/2003 | Tinsman | |
| 6,727,485 | B2 | 4/2004 | Rastegar et al. | |
| 6,884,180 | B2 | 4/2005 | Corzilius et al. | |
| 7,273,431 | B2 | 9/2007 | Devall | |
| 7,682,265 | B2 | 3/2010 | VanDelden | |
| 7,717,373 | B2 | 5/2010 | Jaenker | |
| 7,780,535 | B2 | 8/2010 | Hagood | |
| 7,791,982 | B2 | 9/2010 | Karr | |
| 7,805,276 | B1 | 9/2010 | Byers et al. | |
| 2002/0132684 | A1 * | 9/2002 | Sullivan | 473/355 |
| 2002/0188359 | A1 | 12/2002 | Morse | |
| 2003/0181601 | A1 * | 9/2003 | Hogge et al. | 525/397 |

(Continued)

FOREIGN PATENT DOCUMENTS

| | | | |
|---|---|---|---|
| CN | 1950130 | A | 4/2007 |
| CN | 1953790 | A | 4/2007 |

(Continued)

OTHER PUBLICATIONS

European Search Report dated Jul. 14, 2011 in European Application No. 11157395.

(Continued)

*Primary Examiner* — Tramar Harper
*Assistant Examiner* — Anh Vo V Nguyen
(74) *Attorney, Agent, or Firm* — Quinn Law Group, PLLC

(57) ABSTRACT

A golf ball including a piezoelectric material allows the characteristics of the golf ball to be changed by application of an electric current. An electric current may be applied to the piezoelectric material prior to impact of the golf ball by the golf club using a golf tee with a power source. An electric current may be applied to the piezoelectric material after impact of the golf ball by the golf club and during flight of the golf ball. By selectively applying or removing electric current prior to, during, or after impact with the golf club, the characteristics of the golf ball may be changed and the flight path characteristics of the golf ball may be altered.

9 Claims, 10 Drawing Sheets

(56) References Cited

U.S. PATENT DOCUMENTS

| | | | | |
|---|---|---|---|---|
| 2003/0216228 | A1 | 11/2003 | Rast | |
| 2003/0224878 | A1* | 12/2003 | Sullivan | 473/378 |
| 2003/0228934 | A1 | 12/2003 | Corzilius et al. | |
| 2003/0236353 | A1 | 12/2003 | Rajagopalan | |
| 2004/0084997 | A1* | 5/2004 | Arbogast et al. | 310/328 |
| 2005/0037862 | A1 | 2/2005 | Hagood et al. | |
| 2005/0064950 | A1* | 3/2005 | Carter | 473/280 |
| 2006/0214065 | A1 | 9/2006 | Jaenker | |
| 2008/0045358 | A1 | 2/2008 | VanDelden | |
| 2009/0003136 | A1 | 1/2009 | Karr | |
| 2009/0040761 | A1* | 2/2009 | Huang et al. | 362/253 |
| 2009/0291776 | A1* | 11/2009 | Lin | 473/353 |
| 2010/0022329 | A1* | 1/2010 | Bulpett et al. | 473/372 |
| 2010/0056302 | A1* | 3/2010 | Cheng et al. | 473/376 |
| 2010/0227705 | A1* | 9/2010 | Huang | 473/353 |
| 2011/0009215 | A1 | 1/2011 | Ichikawa et al. | |
| 2011/0136603 | A1* | 6/2011 | Lin et al. | 473/570 |

FOREIGN PATENT DOCUMENTS

| | | | |
|---|---|---|---|
| CN | 2928156 | Y | 8/2007 |
| CN | ZL201120066978.X | | 1/2012 |
| CN | ZL201120066999.1 | B2 | 1/2012 |
| EP | 2364752 | | 12/2012 |
| EP | 2364753 | | 12/2012 |
| GB | 1415487 | | 11/1975 |
| JP | 6210041 | | 8/1994 |
| JP | 9239088 | | 9/1997 |
| JP | 2000500686 | | 1/2000 |
| JP | 3159795 | B2 | 4/2001 |
| JP | 2004041721 | | 2/2004 |
| JP | 5264946 | | 5/2013 |
| WO | WO9749551 | | 12/1997 |
| WO | WO2007/052206 | | 5/2007 |
| WO | WO2007052206 | | 5/2007 |

OTHER PUBLICATIONS

European Search Report dated Jul. 13, 2011 in European Application No. 11157394.

Office Action in Japanese Patent Application No. JP2011-044188, mailed on Nov. 2, 2012.

Notification of Grant of Patent Right for Utility Model in Chinese Utility Application No. 201120066978.X, mailed on Aug. 30, 2011.

Communication under Rule 71(3) in European Patent Application No. EP11157395.2, mailed on Jun. 22, 2012.

Office Action issued Apr. 22, 2013 for Chinese Invention Patent Application No. 201110060005.X.

Office Action issued Jun. 4, 2013 for Chinese Invention Patent Application No. 201110059999.3.

Response to Office Action filed on Feb. 8, 2013 for Office Action mailed on Nov. 2, 2012 in Japanese Patent Application No. 2011-044188.

Notification of Grant of Patent Right for Utility Model in Chinese Utility Model Application No. 201120066999.1, mailed on Aug. 30, 2011.

Communication under Rule 71(3) in European Patent Application No. EP11157394.5, mailed on Jun. 28, 2012.

Final Office Action mailed Feb. 6, 2013 for U.S. Appl. No. 12/722,963.

Notification of Grant mailed Apr. 9, 2013 for Japanese Patent Application No. 2011-044188.

Official Letter and Search Report completed Jul. 10, 2013 for Taiwanese Patent Application No. 100106878, and the English translation thereof.

Official Letter and Search Report completed Jun. 19, 2013 for Taiwanese Patent Application No. 100107533, and English translation excerpt of the Examiner's comments.

Office Action mailed Jul. 25, 2013 for U.S. Appl. No. 12/722,963.

* cited by examiner

GOLF BALL WITH PIEZOELECTRIC MATERIAL

BACKGROUND

The present invention relates to a golf ball containing piezoelectric material, and in particular to a system and method of changing the characteristics of a golf ball containing piezoelectric material.

Golf balls have undergone significant changes over the years. For example, rubber cores have gradually replaced wound cores because of consistent quality and performance benefits such as reducing of driver spin for longer distance. Other significant changes have also occurred in the cover and dimple patterns on the golf ball.

The design and technology of golf balls has advanced to the point that the United States Golf Association ("USGA") has instituted a rule prohibiting the use of any golf ball in a USGA-sanctioned event that can achieve an initial velocity of 250 ft/s, when struck by a driver having a velocity of 130 ft/s (referred to hereafter as "the USGA test".) (The Royal and Ancient Club St. Andrews ("R&A") has instituted a similar rule for R&A-sanctioned events.) Manufacturers place a great deal of emphasis on producing golf balls that consistently achieve the highest possible velocity in the USGA test without exceeding the limit. Even so, golf balls are available with a range of different properties and characteristics, such as velocity, spin, and compression. Thus, a variety of different balls may be available to meet the needs and desires of a wide range of golfers.

Regardless of construction, many players often seek a golf ball that delivers maximum distance. Balls of this nature obviously require a high initial velocity upon impact. As a result, golf ball manufacturers are continually searching for new ways in which to provide golf balls that deliver the maximum performance for golfers at all skill levels, and seek to discover compositions that allow a lower compression ball to provide the performance generally associated with a high compression ball.

A golfer may use different golf balls having different play characteristics depending on the golfer's preferences. For example, different dimple patterns may affect the aerodynamic properties of the golf ball during flight, or a difference in the hardness may affect the rate of backspin. With regard to hardness in particular, a golfer may choose to use a golf ball having a cover layer and/or a core that is harder or softer. A golf ball having a hard cover layer will generally achieve greater distances but less spin, and so will be better for drives but more difficult to control on shorter shots. On the other hand, a golf ball having a softer cover layer will generally experience more spin and therefore be easier to control, but will lack distance.

A wide range of golf balls having a variety of hardness characteristics are known in the art. Generally, the hardness of a golf ball is determined by the chemical composition and physical arrangement of the various layers making up the golf ball. Accordingly, a number of different golf ball materials are mixed and matched in various combinations and arrangements to create golf balls having different hardness values and different hardness profiles.

However, designing golf balls to achieve desired hardness characteristics suffers from at least several difficulties. Generally, the construction of known golf balls requires that a wide range of design variables such as layer arrangement, materials used in each layer, and layer thickness be balanced against each other. Changes to any of these variables may therefore improve a desired hardness only at the expense of other play characteristics. Perhaps most importantly, known golf balls generally cannot simultaneously achieve the advantageous play characteristics associated with high hardness (greater distances) while also achieving the advantageous play characteristics associated with low hardness (greater spin).

Therefore, there is a need in the art for a system and method for providing a golf ball that is capable of having different play characteristics.

SUMMARY

In one aspect, the invention provides a system for hitting a golf ball comprising: a golf ball including a piezoelectric material layer; a golf tee including a power source; and wherein the golf tee is adapted to subject the piezoelectric material layer to an electric current.

In another aspect, the invention provides a golf ball including a cover, the cover comprising: a piezoelectric material; wherein the piezoelectric material comprises a plurality of panels arranged in a geometric pattern; and wherein a plurality of interstitial spaces are disposed between the plurality of panels.

In another aspect, the invention provides a method of changing flight path characteristics associated with a golf ball including a piezoelectric material layer, comprising: providing a golf ball with a piezoelectric material layer; applying a first electric current to the piezoelectric material layer prior to the golf ball being hit by a golf club; applying a second electric current to the piezoelectric material layer for a predetermined period of time after the golf ball is hit by the golf club; and removing the second electric current after the expiration of the predetermined period of time.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
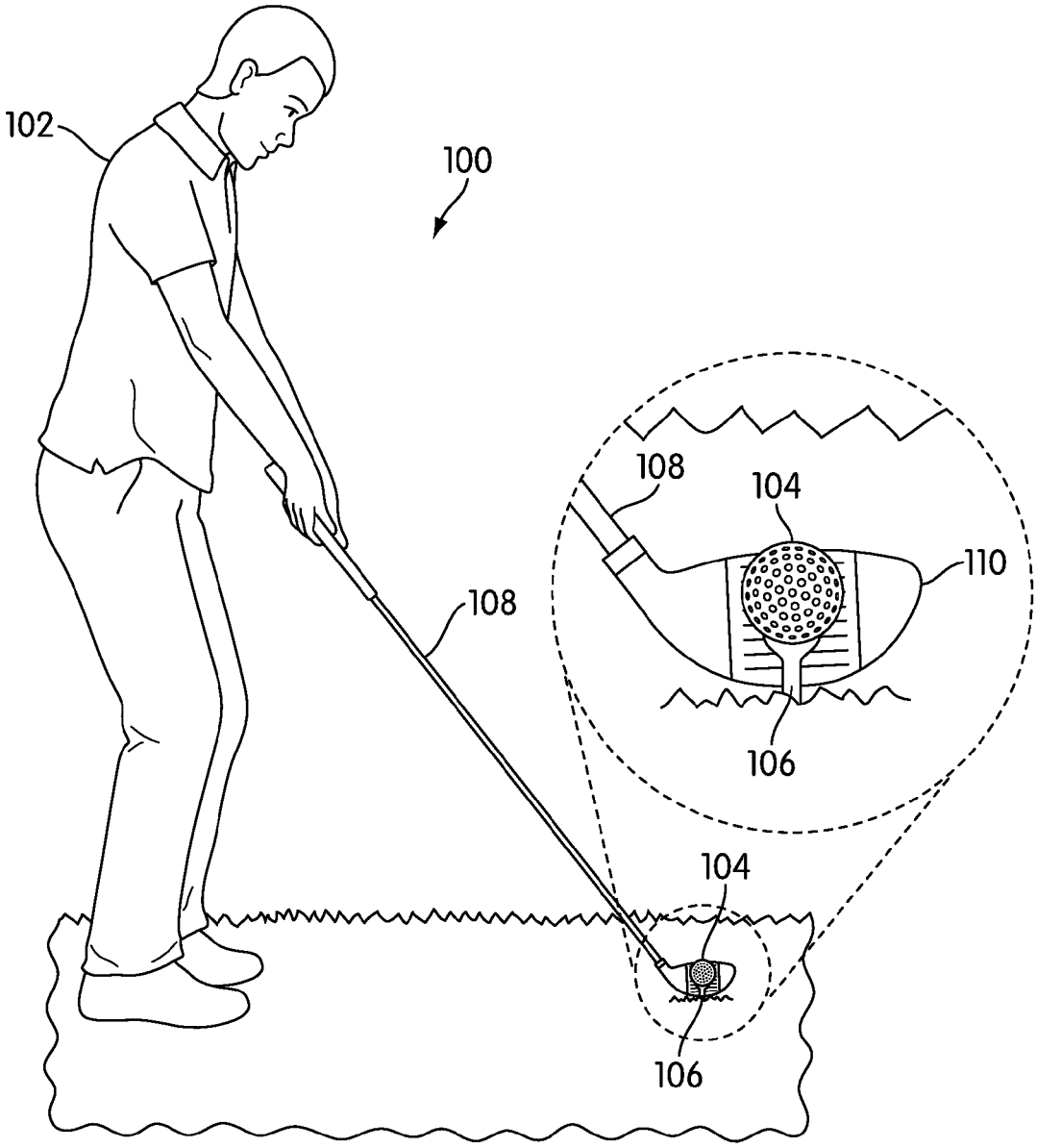
FIG. 1 is an isometric view of a golfer with a golf ball, a golf tee, and a golf club.

An exemplary embodiment of a system 100 for hitting a golf ball is shown in FIG. 1. System 100 may be provided for a golfer 102 to hit a golf ball 104 on a golf tee 106 with a golf club 108. As further discussed in detail below, in an exemplary embodiment, system 100 may change the properties and characteristics golf ball 104. In some embodiments, system 100 may change the properties and characteristics of golf ball 104 while golf ball 104 is on golf tee 106. In other embodiments, system 100 may change the properties and characteristics of golf ball 104 prior to, during, and/or after, being hit by golf club 108. In some cases, system 100 may be provided to change the effect of the impact of golf ball 104 with a club face 110 of golf club 108. In other cases, system 100 may be provided to change the flight path characteristics of golf ball 104 after being hit by golfer 102. In some embodiments, golf ball 104 may contain piezoelectric material. In some embodiments, golf tee 106 may be adapted to subject golf ball 104 to an electric current.

For purposes of illustration, the golf balls shown in the Figures may be depicted with smooth covers. The embodiments shown in the Figures and described in the various embodiments herein may include dimples, including dimple types, configurations, and/or arrangements as is known in the art.

FIGS. 2 through 7 illustrate various different exemplary embodiments of piezoelectric material disposed within a golf ball. Piezoelectric materials are a group of materials that generate an electric potential difference upon application of a mechanical force. In response to an applied force, a voltage is generated in the piezoelectric material that is proportional to the applied force. Similarly, the reverse effect is possible, where an applied voltage will generate a compressive force on the piezoelectric material. One very well known piezoelectric material is quartz, which is typically used in watches. Many other natural and synthetic materials are piezoelectric, including various crystals, ceramics, and polymers.

In one embodiment, the piezoelectric material is a piezoelectric polymer. In some cases, the piezoelectric polymer may include, but is not limited to: polyvinyl fluoride (PVF), polyvinylidene fluoride (PVDF), polyvinyl chloride (PVC), polytetra-fluoroethylene-polyvinylidene fluoride (PTFE-PVF2) and other polymers, copolymers, and ceramic polymer mixtures.

Generally, golf balls can be made in various configurations and can be composed of a variety of materials. Golf balls configurations may include, but are not limited to two piece, three piece, or four piece configurations. Each configuration includes a cover. In some cases, the cover material may include, but is not limited to urethane, balata, synthetic balata, Surlyn®, elastomer, and other materials. The inner composition of a golf ball may include a core, a mantle, and additional core or mantle layers, depending on whether the golf ball is a two piece, three piece, or four piece configuration. The inner composition of a golf ball may include a variety of materials including, but not limited to: natural rubber, balata, synthetic rubber, plastics, thermoplastics, polymers, elastomers, resins, and other materials and combinations of materials.

In one exemplary embodiment, the piezoelectric material may be injected into the golf ball. In some embodiments, the piezoelectric material may be a layer of the golf ball. In other embodiments, the piezoelectric material may be a film. In still other embodiments, the piezoelectric material may be solid material incorporated into the golf ball.

Figure 2:
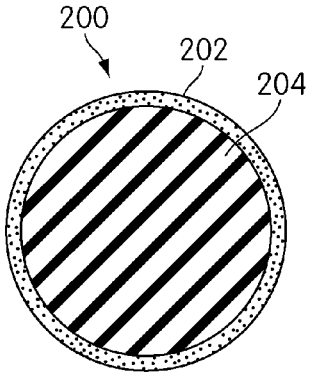
FIG. 2 is a cross-sectional view of an exemplary embodiment of a golf ball with a piezoelectric material cover.
Figure 3:
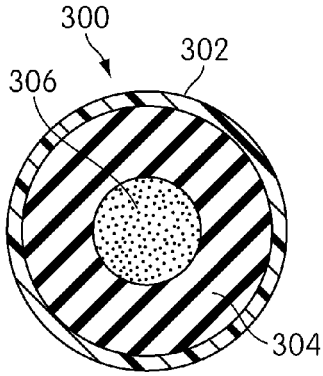
FIG. 3 is a cross-sectional view of an exemplary embodiment of a golf ball with a piezoelectric material core.

Referring now to FIG. 2, in a first exemplary embodiment, a golf ball 200 may comprise a two piece configuration including a cover 202 and a core 204. In this embodiment, cover 202 comprises a piezoelectric material. In different embodiments, core 204 may comprise various natural and synthetic materials conventionally used for golf ball composition. Referring to FIG. 3, in a second exemplary embodiment, a golf ball 300 may comprise a three piece configuration including a cover 302, a mantle layer 304, and a core 306. In this embodiment, core 306 may comprise a piezoelectric material. In different embodiments, cover 302 and/or mantle layer 304 may comprise various natural and synthetic materials conventionally used for golf ball composition.

Figure 4:
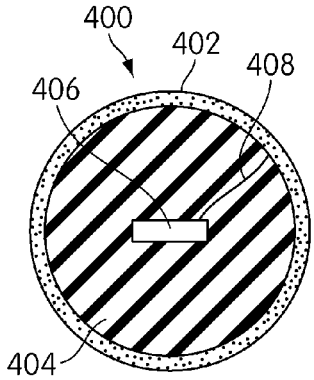
FIG. 4 is a cross-sectional view of an exemplary embodiment of a golf ball with a piezoelectric material cover.

Referring now to FIG. 4, in a third exemplary embodiment, a golf ball 400 may comprise a two piece configuration including a cover 402 and a core 404. In this embodiment, cover 402 comprises a piezoelectric material. In different embodiments, core 404 may comprise various natural and synthetic materials conventionally used for golf ball composition.

In some embodiments, golf ball 400 may include internal circuitry 406 and a connecting lead 408. In some embodiments, internal circuitry 406 may include a processor or other circuitry for applying an electric current to piezoelectric material in cover 402. In some embodiments, internal circuitry 406 may apply an electric current to the piezoelectric material in cover 402 via connecting lead 408. In other embodiments, internal circuitry 406 may not include a connecting lead to apply an electric current to the piezoelectric material in cover 402. In some cases, one or more of the core, mantle, and additional core or mantle layers of the golf ball may include conductive materials. In other cases, cover 402 of golf ball 400 may include conductive material.

Figure 5:
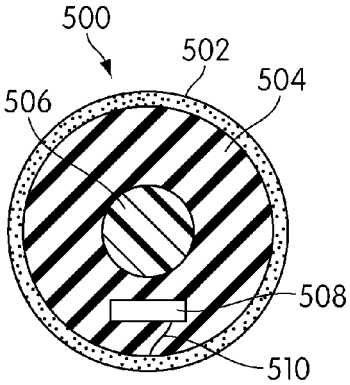
FIG. 5 is a cross-sectional view of an exemplary embodiment of a golf ball with a piezoelectric material cover.

FIG. 5 illustrates a fourth exemplary embodiment of a golf ball 500. In some embodiments, golf ball 500 may comprise a three piece configuration, including a cover 502, a mantle 504, and a core 506. In this embodiment, cover 502 may comprise a piezoelectric material. In different embodiments, mantle 504 and/or core 506 may comprise various natural and synthetic materials conventionally used for golf ball composition. In an exemplary embodiment, golf ball 500 may include internal circuitry 508 and a connecting lead 510. In other embodiments, connecting lead 510 may be optional. Internal circuitry 508 and connecting lead 510 may be substantially identical to internal circuitry 406 and connecting lead 408 discussed above. In this embodiment, internal circuitry 508 is disposed in close proximity to piezoelectric material in cover 502 along one section of golf ball 500. In other embodiments, internal circuitry 508 may be disposed in golf ball 500 in a different relation to the piezoelectric material.

In some embodiments, piezoelectric material may be included in one or more discrete sections of golf ball 500. In some embodiments, internal circuitry 508 may selectively apply an electric current to portions of the piezoelectric material included in one or more discrete sections of golf ball 500. With this arrangement, piezoelectric material in various sections of golf ball 500 may undergo compression due to the applied electric current from internal circuitry 508 at different times to affect different properties and characteristics of golf ball 500. In some embodiments, selective application of an electric current to the piezoelectric material in golf ball 500 by internal circuitry 508 may be used before, during, and/or after golf ball 500 has been hit by a golf club to affect the club face impact and/or flight path characteristics of golf ball 500. In some cases, indicia (not shown) on cover 502 of golf ball 500 may indicate the location of the section of golf ball 500 containing the piezoelectric material.

Figure 6:
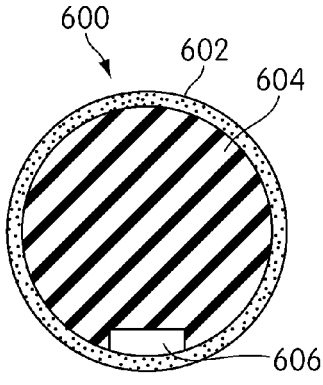
FIG. 6 is a cross-sectional view of an exemplary embodiment of a golf ball with a piezoelectric material cover.

FIG. 6 illustrates a fifth exemplary embodiment of a golf ball 600. In some embodiments, golf ball 600 may comprise a two piece configuration including a cover 602 and a core 604. In this exemplary embodiment, cover 602 may comprise a piezoelectric material. In different embodiments, core 604 may comprise various natural and synthetic materials conventionally used for golf ball composition. In this embodiment, golf ball 600 may include internal circuitry 606. Internal circuitry 606 may be substantially identical to internal circuitry 406 discussed above. In this embodiment, internal circuitry is in contact with the piezoelectric material in cover 602. With this arrangement, internal circuitry 606 may apply an electric current to the piezoelectric material.

Figure 7:
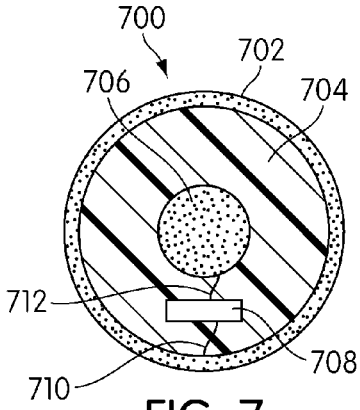
FIG. 7 is a cross-sectional view of an exemplary embodiment of a golf ball with a piezoelectric material cover and a piezoelectric material core.

FIG. 7 illustrates a sixth exemplary embodiment of a golf ball 700. In some embodiments, golf ball 700 may comprise a three piece configuration, including a cover 702, a mantle 704, and a core 706. In this embodiment, cover 702 and core 706 may comprise a piezoelectric material. In different embodiments, mantle 704 may comprise various natural and synthetic materials conventionally used for golf ball composition. In an exemplary embodiment, golf ball 700 may include internal circuitry 708, a cover connecting lead 710, and a core connecting lead 712. Internal circuitry 708 may be substantially identical to internal circuitry 406 discussed above. Similarly, cover connecting lead 710 and/or core connecting lead 712 may be substantially identical to connecting lead 408 discussed above. In other embodiments, either or both of cover connecting lead 710 and core connecting lead 712 may be optional.

In some embodiments, piezoelectric material may be included in one or more portions of golf ball 700. In the exemplary embodiment shown in FIG. 7, piezoelectric material may comprise cover 702 and/or core 706 of golf ball 700. In some embodiments, internal circuitry 708 may selectively apply an electric current to the piezoelectric material included in one or more portions of golf ball 700, including cover 702 and/or core 706. With this arrangement, piezoelectric material in various portions of golf ball 700 may undergo compression due to the applied electric current from internal circuitry 708 at different times to affect different properties and characteristics of golf ball 700.

In some embodiments, selective application of an electric current to the piezoelectric material in golf ball 700 by internal circuitry 708 may be used before, during, and/or after golf ball 700 has been hit by a golf club to affect the club face impact and/or flight path characteristics of golf ball 700. In one exemplary embodiment, internal circuitry 708 may apply an electric current to the piezoelectric material in cover 702 via cover connecting lead 710 prior to golf ball 700 being hit with a golf club. In another exemplary embodiment, internal circuitry 708 may selectively remove the electric current to the piezoelectric material in cover 702 a predetermined amount of time after golf ball 700 has been hit by a golf club. In different embodiments, internal circuitry 708 may apply and/or remove the electric current to the piezoelectric material in cover 702 before, during, and/or after golf ball 700 has been hit by a golf club to affect the club face impact and/or flight path characteristics of golf ball 700.

In another exemplary embodiment, internal circuitry 708 may apply an electric current to the piezoelectric material in core 706 via core connecting lead 712. In some embodiments, internal circuitry 708 may apply the electric current to the piezoelectric material in core 706 via core connecting lead 712. In one exemplary embodiment, internal circuitry 708 may apply and/or remove the electric current to the piezoelectric material in core 706 to affect the properties and characteristics of an impact of a club face of a golf club with golf ball 700. In different embodiments, internal circuitry 708 may apply and/or remove the electric current to the piezoelectric material in core 706 before, during, and/or after golf ball 700 has been hit by a golf club to affect the club face impact and/or flight path characteristics of golf ball 700.

In other embodiments, the electric current may be applied to one or more portions of golf ball 700 via an external apparatus. In one exemplary embodiment discussed below, an electric current may be applied to a golf ball containing piezoelectric material via a golf tee including a power source.

In the above described embodiments, piezoelectric material comprises the cover and/or the core of a golf ball. In different embodiments, piezoelectric material may comprise any layer of a golf ball, including one or more of the core, mantle, and additional core or mantle layers.

In one exemplary embodiment, a golf ball may comprise a three piece configuration, including a mantle comprised of a piezoelectric material and a core and a cover comprised various natural and synthetic materials conventionally used for golf ball composition. In this embodiment, an electric current may be applied to the piezoelectric material included in the mantle of the golf ball, using the internal circuitry described above and/or external apparatus described below. With this arrangement, the piezoelectric material in the mantle of the golf ball may undergo compression due to the applied electric current to affect different properties and characteristics of golf ball. In one embodiment, the applied electric current to the piezoelectric material in the mantle of the golf ball may give the golf ball a larger apparent hardness and/or increase internal stress within the golf ball.

In other embodiments, piezoelectric material may be disposed in one or more layers of a golf ball. In some cases, piezoelectric material may be disposed between or among any combination of the core, mantle, and additional core or mantle layers. In other embodiments, piezoelectric material may be disposed on the outside of cover.

Figure 8:
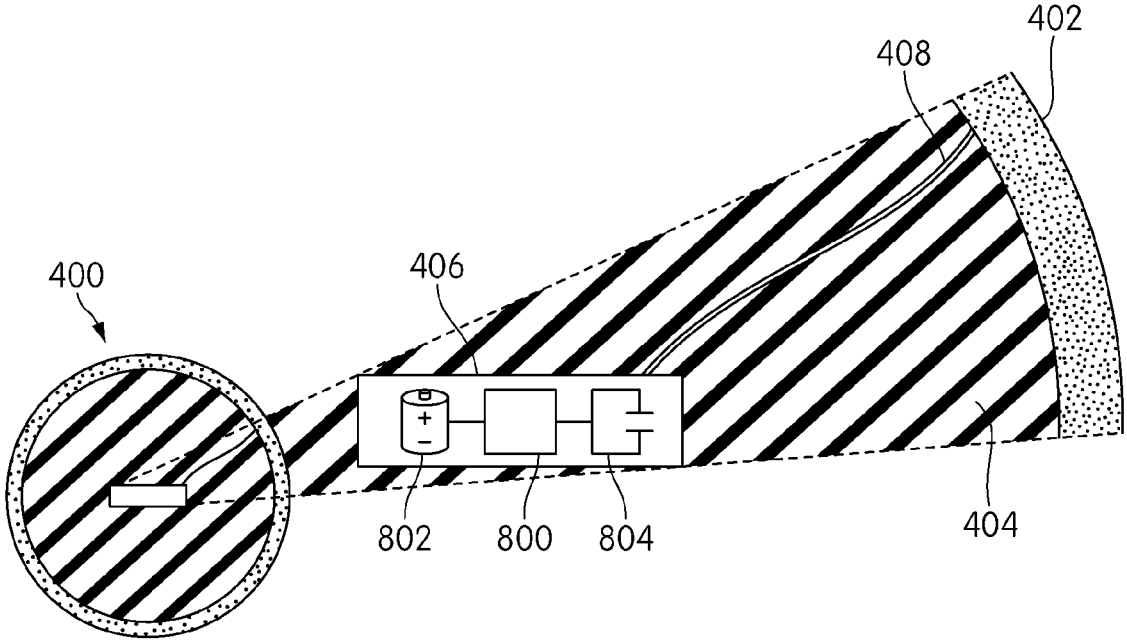
FIG. 8 is an enlarged cross-sectional view of an exemplary embodiment of a golf ball with a piezoelectric material cover and an internal energy storage device.

FIG. 8 illustrates an exemplary embodiment of internal circuitry within golf ball 400. As shown in FIG. 8, golf ball 400 may include internal circuitry 406. In some embodiments, internal circuitry 406 includes an energy storage device. In some cases, the energy storage device may include a battery. In other cases, the energy storage device may include a capacitor. In still other cases, the energy storage device may include any apparatus for generating an electric current. In one exemplary embodiment, internal circuitry 406 may include a battery 802 and/or a capacitor 804. Internal circuitry may use energy stored in battery 802 and/or capacitor 804 to apply an electric current to the piezoelectric material in cover 402 via connecting lead 408. In some embodiments, internal circuitry 406 may include a processor 800 for generating an electric current. Processor 800 may include a processor or other circuitry for generating electric current of any kind known in the art. In other embodiments, processor 800 may include a timer circuit for selectively applying and/or removing the electric current for a predetermined period of time, upon an initiation event, or using any other criteria. In other embodiments, processor 800 may be programmed to execute various instructions and programs as is known in the art.

In other embodiments, internal circuitry 406 also may include an internal sensor for detecting the output from the piezoelectric material in cover 402 via connecting lead 408 when hit by a golf club. In some embodiments, internal circuitry 406 also may include a data storage device. A data storage device may store data from an internal sensor generated when golf ball 400 is hit by a golf club. In one embodiment, a data storage device may be used to record data associated with a golfer hitting golf ball 400 multiple times. In other embodiments, a data storage device may be used to record data associated with a golfer hitting a golf ball, such as golf ball 400, during play.

Figure 9:
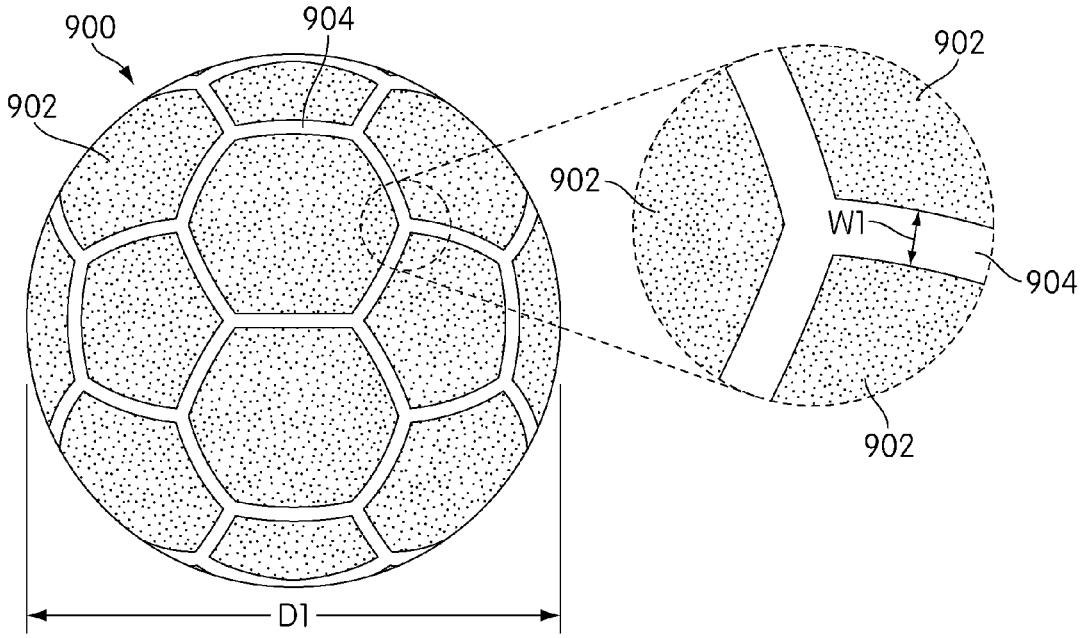
FIG. 9 is an isometric view of an exemplary embodiment of a golf ball with a piezoelectric material cover arranged in a geometric pattern.
Figure 10:
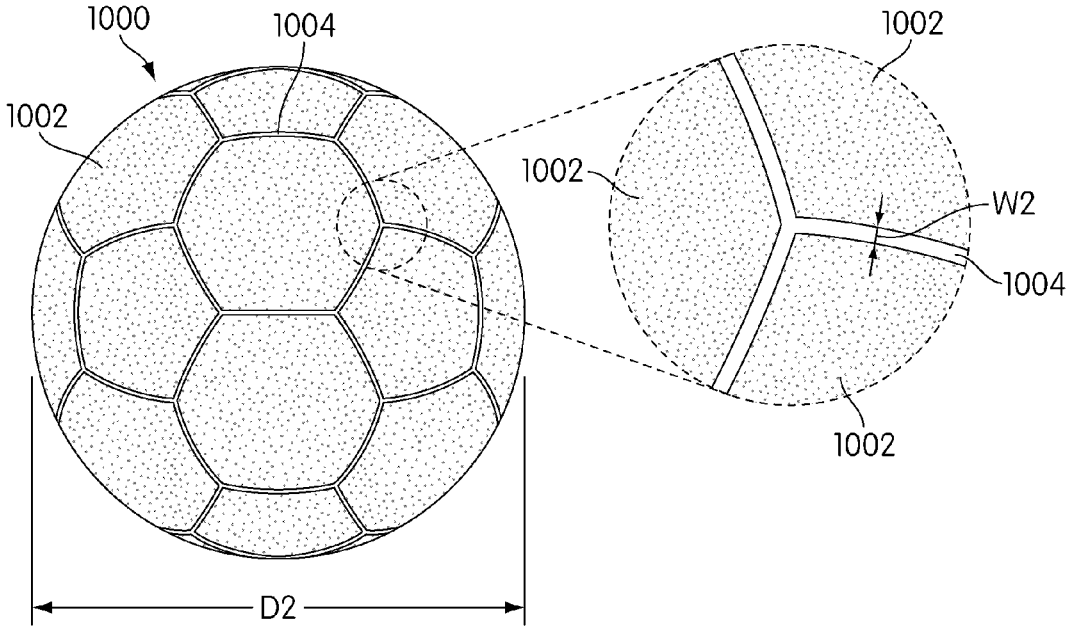
FIG. 10 is an isometric view of an exemplary embodiment of a golf ball with a piezoelectric material cover arranged in a geometric pattern.

FIGS. 9 and 10 illustrate views of an exemplary embodiment of a golf ball with a piezoelectric material cover arranged in a geometric pattern. Referring to FIG. 9, in this embodiment, a golf ball 900 may include a cover comprising a piezoelectric material. In some embodiments, the piezoelectric material cover may be arranged in a geometric pattern over the outer surface of golf ball 900. In one exemplary embodiment, the geometric pattern may be formed by a plurality of panels 902 comprised of the piezoelectric material. In some embodiments, a plurality of interstitial spaces 904 may be disposed between panels 902. In an exemplary embodiment, interstitial spaces 904 may be provided to allow panels 902 comprising the piezoelectric material cover to compress when subjected to an electric current. In this embodiment, interstitial spaces 904 may have a first width W1 that is associated with the distance between panels 902 in the absence of an applied electric current. In some cases, first width W1 may be associated with a first diameter D1 of golf ball 900. In different embodiments, interstitial spaces 904 may be sized and dimensioned to correspond to various widths to provide for the compression and expansion of panels 902 comprising the piezoelectric material cover of golf ball 900.

In one exemplary embodiment, panels 902 disposed over the outer surface of golf ball 900 to form the piezoelectric material cover may be arranged in a geometric pattern comprising a combination of hexagonal and pentagonal shapes. In other embodiments, panels 902 may be arranged in various patterns, including, but not limited to: hexagonal, pentagonal, triangular, circular, ovoid, elliptical, and other geometric, regular and/or irregular patterns, or combinations thereof.

Referring now to FIG. 10, in this embodiment, a golf ball 1000 is shown with a cover comprising a piezoelectric material in the presence of an applied electric field. In some embodiments, the piezoelectric material cover may be arranged in a geometric pattern over the outer surface of golf ball 1000 as described above in reference to FIG. 9. In one exemplary embodiment, the geometric pattern may be formed by a plurality of panels 1002 comprised of the piezoelectric material in a compressed state. In this embodiment, panels 1002 are compressed due to the presence of an applied electric current.

In some embodiments, interstitial spaces 1004 may be disposed between compressed panels 1002. In an exemplary embodiment, interstitial spaces 1004 may be provided to allow compressed panels 1002 comprising the piezoelectric material cover to form a substantially continuous cover when subjected to an electric current. In different embodiments, interstitial spaces 1004 may be sized and dimensioned to correspond to various widths to provide for the compression and expansion of panels 1002 comprising the piezoelectric material cover of golf ball 1000. In the embodiment of FIG. 10, interstitial spaces 1004 may have a second width W2 that is associated with the marginal distance between panels 1004 in the presence of an applied electric current. In some cases, second width W2 may be associated with a second diameter D2 of golf ball 1000. In an exemplary embodiment, second width W2 may be substantially smaller than first width W1. In one embodiment, first diameter D1 of golf ball 900 in the absence of an applied electric current may be larger than second diameter D2 of golf ball 1000 in the presence of an applied electric current. In some embodiments, first diameter D1 and/or second diameter D2 may correspond to a diameter of approximately 1.68 inches. In other embodiments, first diameter D1 and/or second diameter D2 may be greater than or less than 1.68 inches. In still other embodiments, first diameter D1 and/or second diameter D2 may be sized and dimensioned so as to conform with one or more regulations applicable to golf balls used for professional and/or amateur golf.

Figure 11:
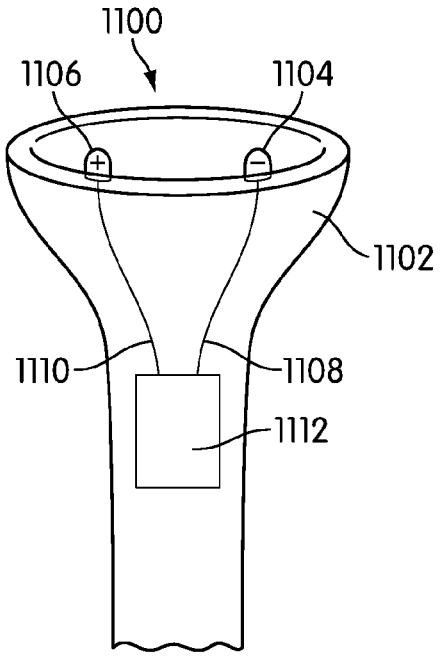
FIG. 11 is a schematic view of an exemplary embodiment of a golf tee adapted to subject a golf ball to an electric current.
Figure 12:
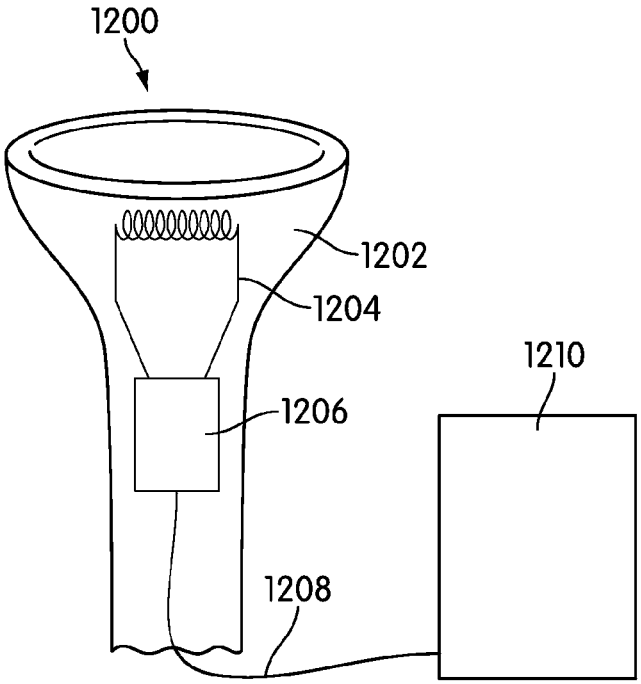
FIG. 12 is a schematic view of an alternative exemplary embodiment of a golf tee adapted to subject a golf ball to an electric current.

FIGS. 11 and 12 illustrate different embodiments of an external apparatus for applying an electric field to a golf ball including a piezoelectric material. Referring to FIG. 11, a golf tee 1100 may be adapted to subject a golf ball containing piezoelectric material to an electric current. In this embodiment, golf tee 1100 may include an upper surface 1102 for holding the golf ball in place. In some embodiments, golf tee 1100 may include a first contact member 1104 and a second contact member 1106 disposed on upper surface 1102. In one embodiment, first contact member 1104 and second contact member 1106 may be provided to apply an electric current to a golf ball when placed in communication with first contact member 1104 and/or second contact member 1106 on upper surface 1102 of golf tee 1100.

In some embodiments, golf tee 1100 may include a power source 1112. In some cases, power source 1112 may be a battery and/or a capacitor. In other cases, power source 1112 may be supplied via an external power supply. In one embodiment, first contact member 1104 may correspond to a positive terminal connected to power source 1112 via a positive lead 1110. Similarly, second contact member 1106 may correspond to a negative terminal connected to power source 1112 via a negative lead 1108. In some embodiments, golf tee 1100 may use power source 1112 to apply an electric current to a piezoelectric material layer of a golf ball when the golf ball is placed in communication with first contact member 1104 and/or second contact member 1106 on upper surface 1102 of golf tee 1100. In this embodiment, the electric current applied to the golf ball in communication with first contact member 1104 and second contact member 1106 may be generated from power source 1112 via negative lead 1108 and positive lead 1110.

Referring now to FIG. 12, in this embodiment, a golf tee 1200 may be adapted to subject a golf ball containing piezoelectric material to an electric current. In some embodiments, golf tee 1200 may use an induction coil 1204 connected to a power source 1206 to generate an applied electric current. In some cases, power source 1206 may be a battery and/or a capacitor. In other cases, power source 1206 may be supplied via an external power supply. In this embodiment, golf tee 1200 may include an upper surface 1202 for holding the golf ball in place. In one exemplary embodiment, golf tee 1200 may be connected via connection 1208 to a sensor 1210 for detecting a swinging motion of a golf club. In one embodiment, sensor 1210 may include an optical detector for detecting a swinging motion of a golf club in proximity to golf tee 1200. In other embodiments, sensor 1210 may include one or more other sensors that may detect the presence of a golf club, including, but not limited to: optical, acoustical, magnetic, and other known sensors for detecting motion of a golf club.

In some embodiments, golf tee 1200 and/or sensor 1210 may be in communication with a processor. The processor may be adapted to control power source 1206 to subject the piezoelectric material in a golf ball to an electric current in response to receiving a signal from sensor 1210 detecting the swinging motion of a golf club. In other embodiments, golf tee 1200 may include a pressure-sensitive contact member (not shown) to apply an electric current to a golf ball when placed in communication with the contact member on upper surface 1202 of golf tee 1200.

In some embodiments, golf tee 1100 and/or golf tee 1200 may apply an electric current to the piezoelectric material included in one or more portions of a golf ball, including, but not limited to the exemplary embodiments of a golf ball with piezoelectric material described above. With this arrangement, piezoelectric material in various portions of a golf ball may undergo compression from the applied electric current from golf tee 1100 and/or golf tee 1200 at different times to affect different properties and characteristics of a golf ball.

In some embodiments, selective application of an electric current to the piezoelectric material in a golf ball by golf tee 1100 and/or golf tee 1200 may be used before, during, and/or after a golf ball has been hit by a golf club to affect the club face impact and/or flight path characteristics of the golf ball. In one exemplary embodiment, golf tee 1100 and/or golf tee 1200 may apply an electric current to the piezoelectric material in a cover of the golf ball prior to the golf ball being hit with a golf club.

FIGS. 13-17 illustrate a series of views of an exemplary embodiment of a golf ball with a piezoelectric material being hit by a golf club 108. The order of the steps illustrated in FIGS. 13-17 is exemplary and not required. By selectively applying and/or removing an electric current to the piezoelectric material contained in a golf ball, as discussed above, the properties and characteristics of a golf ball may be changed, including, but not limited to: amount of deformation, ball speed, backspin, sidespin, total spin, and other parameters associated with a golf ball. With this arrangement, the club face impact characteristics and/or flight path characteristics of the golf ball may be altered.

By applying an electric current to piezoelectric material included in a cover of a golf ball, the electric current may cause the piezoelectric material to compress, thus hardening the cover of the golf ball. With this arrangement, by selectively applying the electric current to piezoelectric material contained in a golf ball prior to impact of the golf ball by a club face of a golf club, the club face impact characteristics and/or flight path characteristics of the golf ball may be changed. In one exemplary embodiment, a ball speed and a spin rate may be affected by applying an electric current to the piezoelectric material in a golf ball prior to impact. Ball speed is the measurement of the velocity of a golf ball after impact with a club head of a golf club. Because ball speed is proportional to the force of the impact of the club head with the golf ball, the ball speed may be increased by compressing the piezoelectric material to make the cover of the golf ball harder prior to impact.

The spin of a golf ball is the rotation of a golf ball while in flight. Spin includes rotation against the direction of flight, i.e., backspin, and rotation sideways to the direction of spin, i.e., side spin. Total spin is the vector addition of backspin and side spin. The spin rate of a golf ball is the speed that the golf ball rotates on its axis while in flight. Typically, the spin rate is measured in revolutions per minute (rpm). The spin of a golf ball is related to an amount of deformation of the golf ball. The amount of deformation of the golf ball may vary based on the hardness of the golf ball, whereby a harder golf ball generally will deform less than a softer golf ball. A harder golf ball may generally achieve greater distances but have less spin. On the other hand, a softer golf ball may generally experience more spin, but will lack distance. Based on the selective application of an electric current to the piezoelectric material contained in a golf ball, the hardness may be changed, thus affecting the deformation amount and changing the spin rate of the golf ball. Similarly, in embodiments where piezoelectric material is included in a core of a golf ball, selective application of an electric current to the piezoelectric material in the core may affect a bounce back reaction after impact of the golf ball with the golf club.

In some embodiments, application of the electric current to piezoelectric material in the golf ball may change the material properties associated with the golf ball. In some cases, the electric current applied to the piezoelectric material may cause the piezoelectric material to compress. The effect of the internal stress inside the golf ball caused by the compressed piezoelectric material is similar to the effect from increasing the hardness of the golf ball. As a result, compression of the piezoelectric material in the golf ball may give the golf ball a larger apparent hardness caused by the compressed piezoelectric material.

Figure 13:
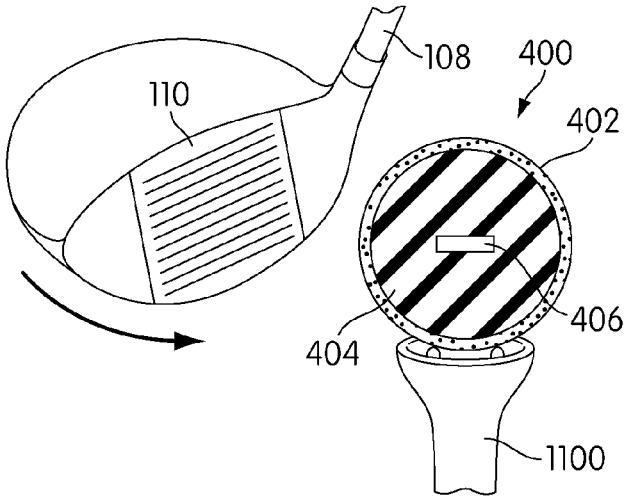
FIG. 13 is a representational view of an exemplary embodiment of a golf ball with piezoelectric material on a golf tee about to be hit by a golf club.
Figure 14:
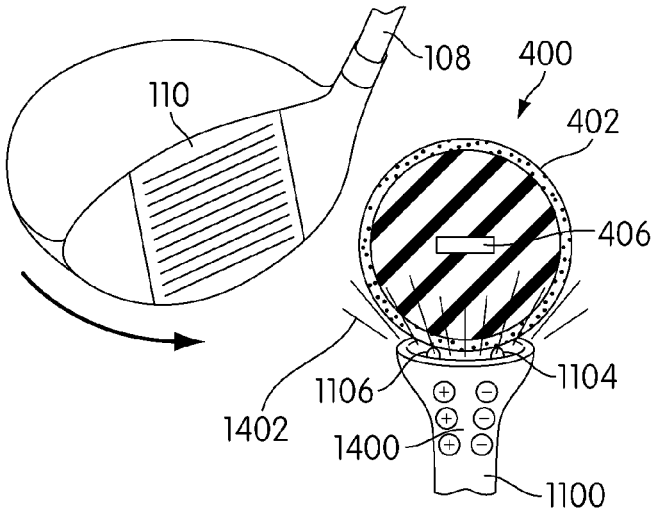
FIG. 14 is a representational view of an exemplary embodiment of a golf ball with piezoelectric material being subjected to an electric current by a golf tee.

Referring now to FIG. 13, a golf ball 400 including a cover 402 comprising piezoelectric material may be provided on a golf tee 1100 adapted to provide an electric current. In this embodiment, the piezoelectric material in cover 402 is in an uncompressed state in the absence of an applied electric current from golf tee 1100. Referring to FIG. 14, prior to impact of club face 110 of golf club 108 with golf ball 400, golf tee 1100 may use electricity 1400 from a power source to generate an electric current 1402, as discussed above. In this embodiment, golf tee 1100 applies electric current 1402 to the piezoelectric material of golf ball 400 when golf ball 400 is placed in communication with first contact member 1104 and/or second contact member 1106 on the upper surface of golf tee 1100.

Figure 15:
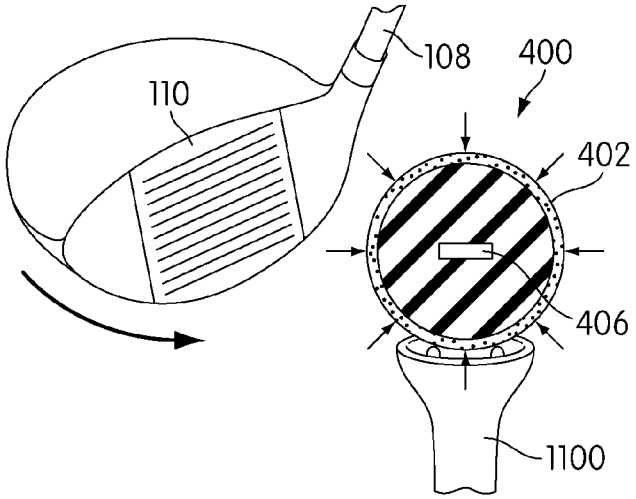
FIG. 15 is a representational view of an exemplary embodiment of a golf ball with piezoelectric material in a compressed state on a golf tee about to be hit by a golf club.
Figure 16:
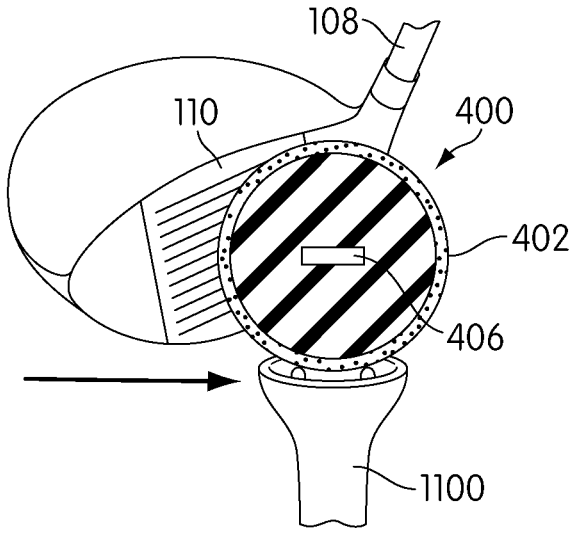
FIG. 16 is a representational view of an exemplary embodiment of a golf ball with piezoelectric material in a compressed state being hit by a golf club.

Referring now to FIG. 15, electric current 1402 applied to the piezoelectric material contained in cover 402 of golf ball 400 causes the piezoelectric material to compress. As a result, cover 402 of golf ball 400 may be made harder prior to impact of club face 110 with golf ball 400. Additionally, by compressing cover 402, a diameter of golf ball 400 may be made smaller, as discussed above. As shown in FIG. 16, club face 110 of golf club 108 makes contact with golf ball 400. As club face 110 makes contact with golf ball 400, kinetic energy is transferred from club face 110 to golf ball 400. As discussed above, compression of piezoelectric material in cover 402 may cause golf ball 400 to be harder, resulting in a greater transfer of kinetic energy to golf ball 400 and, accordingly, a higher ball speed.

Figure 17:
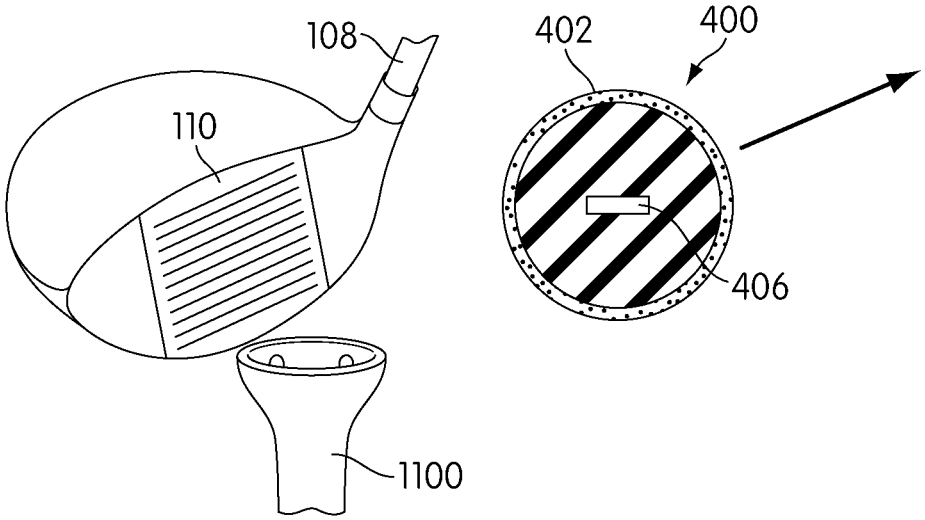
FIG. 17 is a representational view of an exemplary embodiment of a golf ball with piezoelectric material in a compressed state in flight after being hit by a golf club.

Referring now to FIG. 17, after impact of golf ball 400 with club face 110 of golf club 108, golf ball 400 may continue on an initial flight path. The initial flight path may be associated with the club face impact characteristics and/or flight path characteristics of the golf ball 400 when hit by golf club 108, including, but not limited to those characteristics affected by the presence or absence of an applied electric current prior to impact. In some embodiments, internal circuitry 406 may apply an electric current to the piezoelectric material in golf ball 400, as discussed above, after impact and/or during the flight of golf ball 400 on the initial flight path. In an exemplary embodiment, internal circuitry 406 may selectively apply and/or remove an electric current to the piezoelectric material in cover 402 of golf ball 400 to affect the flight path characteristics of golf ball 400. In one exemplary embodiment, internal circuitry 406 may selectively apply and/or remove the electric current to the piezoelectric material in cover 402 of golf ball 400 to alter the distance and/or loft of the initial flight path.

Figure 18:
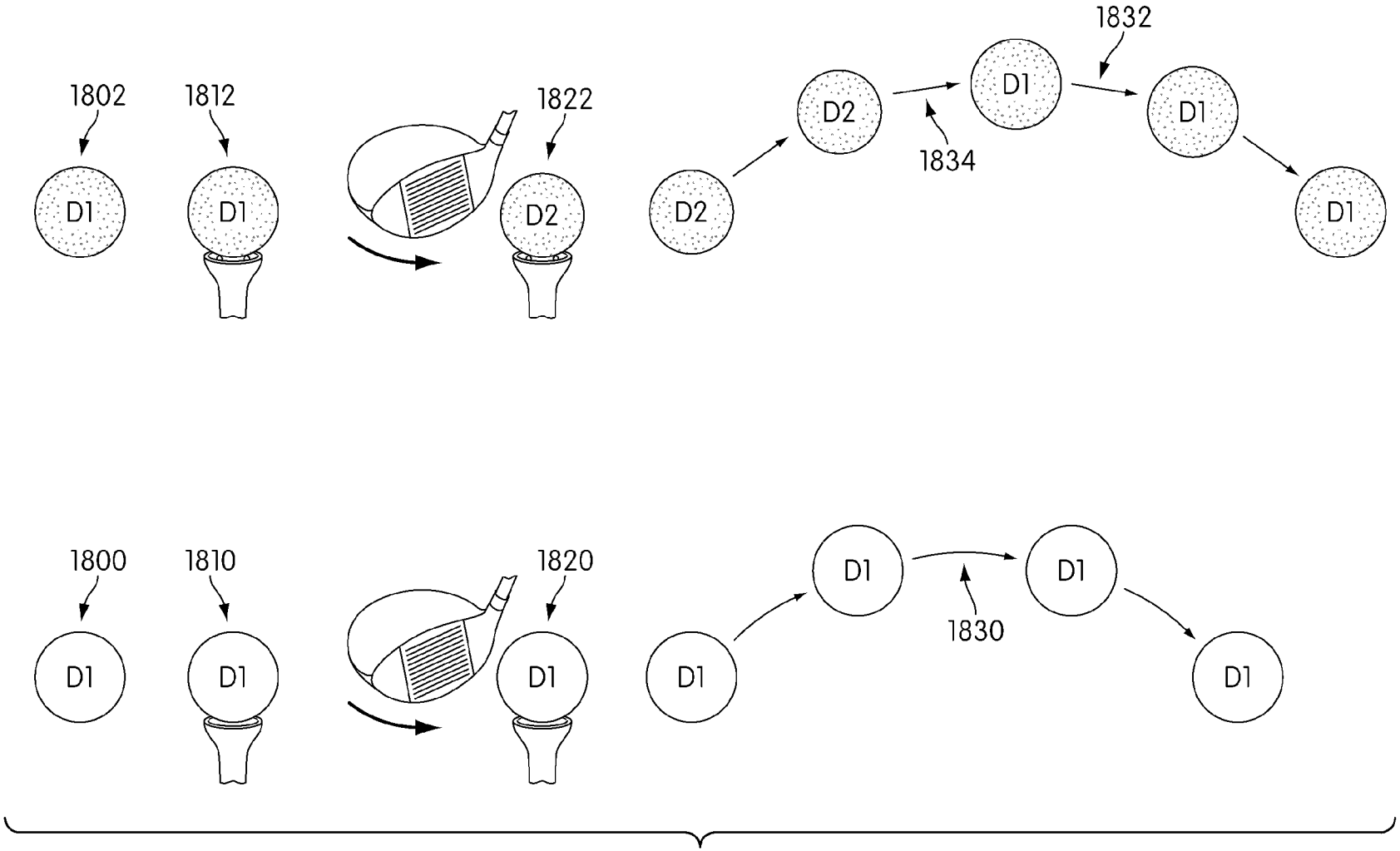
FIG. 18 is a representational view of an exemplary embodiment of a golf ball with piezoelectric material with changing flight path characteristics compared to a conventional ball and conventional flight path characteristics.

FIG. 18 illustrates a comparison of the club face impact characteristics and/or flight characteristics of a conventional golf ball 1800 and an exemplary embodiment of a golf ball including piezoelectric material 1802 subjected to an electric current. The order of the steps illustrated in FIG. 18 is exemplary and not required. Referring to FIG. 18, a conventional golf ball 1800 may be associated with a first diameter D1. Conventional golf ball 1800 will maintain first diameter D1 when placed on a conventional golf tee at step 1810 and when hit by a golf club at step 1820. Depending on the configuration and composition of conventional golf ball 1800, it will exhibit a typical flight path 1830 that may vary depending on initial launch conditions, such as club head speed and launch angle, but will not ordinarily change once conventional golf ball 1800 is in flight.

On the other hand, golf ball 1802 including piezoelectric material may be associated with a first diameter D1 in the absence of an applied electric current, as illustrated at step 1812, and may be associated with a second diameter D2 in the presence of an applied electric current, as illustrated at step 1822. With this arrangement, the properties and characteristics of golf ball including piezoelectric material 1802 may be changed prior to impact with a golf club, as shown at step 1814, by application of an electric current. In different embodiments, the electric current may be supplied by a golf tee and/or internal circuitry inside golf ball 1802, as discussed in the embodiments above.

In this embodiment, the applied electric current to the piezoelectric material may cause the cover of golf ball 1802 to compress prior to impact with the club face of a golf club, thereby causing golf ball 1802 to have second diameter D2 that is smaller than first diameter D1 associated with golf ball 1802 in the absence of the electric current. With this arrangement, the diameter of golf ball 1802 may be changed by selective application of the electric current to the piezoelectric material in the cover. In one exemplary embodiment, internal circuitry may remove the applied electric current at step 1834 to cause the diameter of golf ball 1802 to increase from second diameter D2 to first diameter D1 while golf ball 1802 is in flight. The larger relative diameter of first diameter D1 at step 1832 may increase the air resistance of golf ball 1802, thereby increasing loft of golf ball 1802 along its flight path.

Figure 19:
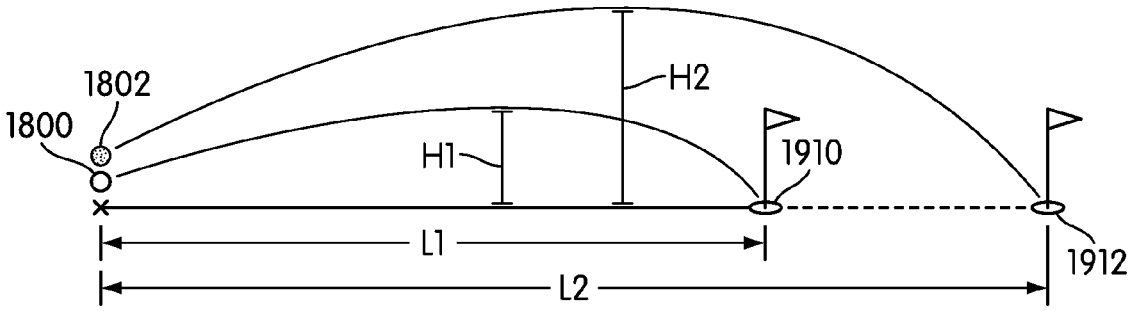
FIG. 19 is a representational view of the flight paths of an exemplary embodiment of a golf ball with piezoelectric material compared to a conventional ball.

FIG. 19 illustrates a comparison of the flight paths of conventional golf ball 1800 and golf ball 1802 including piezoelectric material subjected to an electric current according to the methods described herein. As shown in FIG. 19, conventional golf ball 1800 may have a conventional flight path terminating at end point 1910. The conventional flight path of golf ball 1800 may be associated with a first distance L1 to end point 1910 and also may be associated with a loft corresponding to a first height H1. In contrast, golf ball 1802 including piezoelectric material subjected to an electric current according to the methods described herein for changing the flight path characteristics may have an exemplary flight path terminating at end point 1912. In this embodiment, exemplary flight path of golf ball 1802 may be associated with a second distance L2 to end point 1912 and also may be associated with a loft corresponding to a second height H2.

In some embodiments, by using the systems and methods described herein to apply and/or remove an electric current to piezoelectric material in a golf ball, parameters associated with a flight path of golf ball may be changed or altered. In an exemplary embodiment, by applying an electric current to the piezoelectric material included in golf ball 1802 as described herein, second distance L2 may be greater than first distance L1 associated with conventional golf ball 1800. Similarly, in another exemplary embodiment, by selectively applying and/or removing an electric current to the piezoelectric material included in golf ball 1802 as described herein, second height H2 associated with the loft of golf ball 1802 may be greater than first height H1 associated with the loft of conventional golf ball 1800.

In other embodiments, by using the systems and methods described herein to apply and/or remove an electric current to piezoelectric material in a golf ball, parameters associated with a flight path of golf ball may be changed or altered to impart more spin to a golf ball. In one embodiment, applying more spin to golf ball 1802 including piezoelectric material may cause the second distance L2 to be less than first distance L1. In other embodiments, an electric current may be applied to golf ball 1802 including piezoelectric material during the flight path to cause second height H2 to be less than first height H1. In different embodiments, various combinations of selective application and/or removal of electric current to cause piezoelectric material contained in a golf ball to contract and/or expand at various points along a flight path of the golf ball may be used to achieve larger or smaller loft heights and/or distances.

In the above embodiments, a piezoelectric material that compresses in the presence of an applied electric field has been described. Other types of piezoelectric materials may have different properties in the presence of an applied electric field. In one embodiment, a piezoelectric material may expand in the presence of an applied electric field. In one exemplary embodiment, the piezoelectric material may comprise lead zirconate titanate (PZT). In different embodiments, the expanding piezoelectric material may be used in any of the embodiments of a golf ball including piezoelectric material described above.

Figure 20:
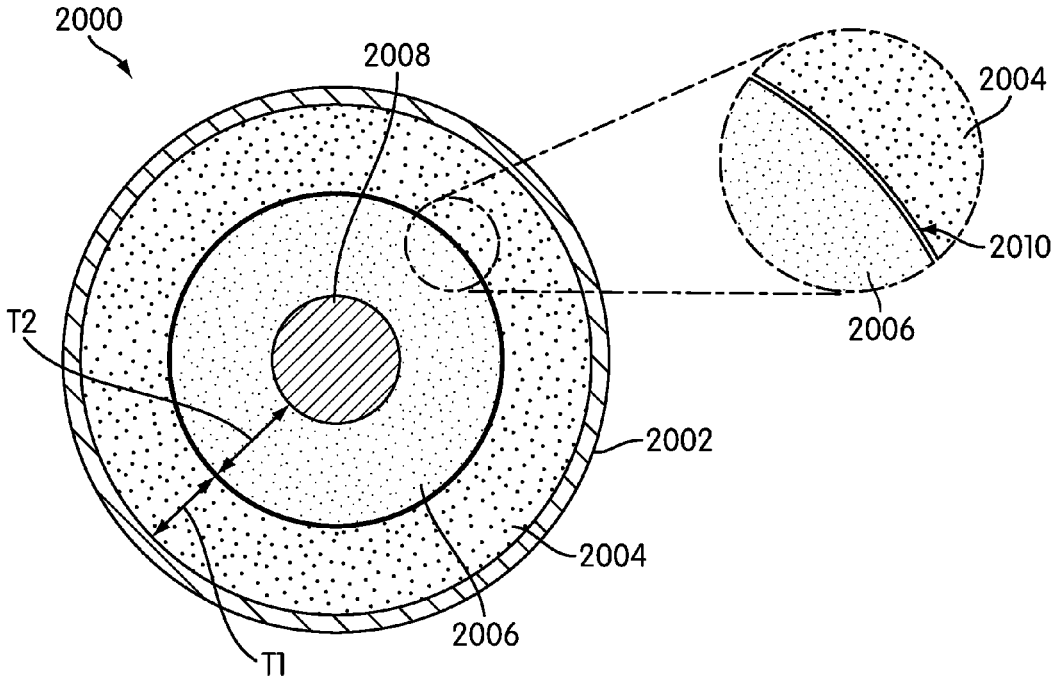
FIG. 20 is a cross-sectional view of an exemplary embodiment of a golf ball with an outer mantle comprising a first piezoelectric material and an inner mantle comprising a second piezoelectric material.
Figure 21:
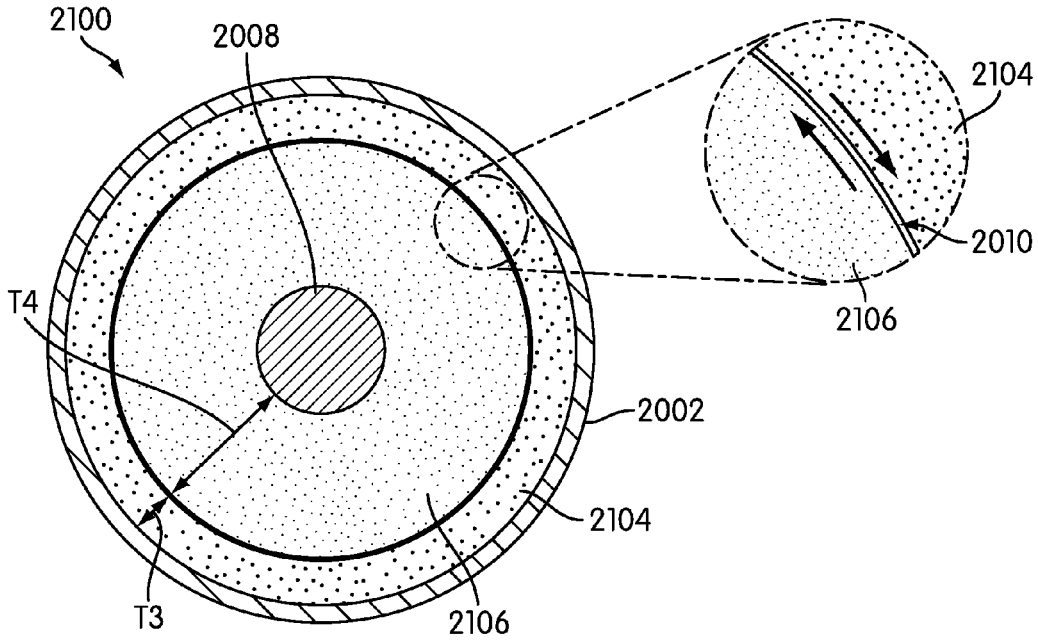
FIG. 21 is a cross-sectional view of an exemplary embodiment of a golf ball with an outer mantle comprising a first piezoelectric material and an inner mantle comprising a second piezoelectric material undergoing internal stress.

Referring now to FIGS. 20 and 21, an exemplary embodiment of a golf ball with an inner mantle layer and an outer mantle layer comprising piezoelectric material is shown. Referring to FIG. 20, in this exemplary embodiment, a golf ball 2000 may comprise a four piece configuration including a cover 2002, an outer mantle layer 2004, an inner mantle layer 2006, and a core 2008. In this embodiment, outer mantle layer 2004 and inner mantle layer 2006 may comprise a piezoelectric material. In different embodiments, cover 2002 and/or core 2008 may comprise various natural and synthetic materials conventionally used for golf ball composition.

In some embodiments, outer mantle layer 2004 and inner mantle layer 2006 may comprise a substantially similar piezoelectric material. In other embodiments, outer mantle layer 2004 and inner mantle layer 2006 may comprise different piezoelectric materials. In this embodiment, outer mantle layer 2004 may comprise a first piezoelectric material and inner mantle layer 2006 may comprise a second piezoelectric material. In some embodiments, the first piezoelectric material and the second piezoelectric material may have different properties. In one exemplary embodiment, the first piezoelectric material compresses in the presence of an applied electric current and the second piezoelectric material expands in the presence of an applied electric current.

In the embodiment shown in FIG. 20, outer mantle layer 2004 may have a first thickness T1 associated with the first piezoelectric material in the absence of an applied electric current. Similarly, inner mantle layer 2006 may have a second thickness T2 associated with the second piezoelectric material in the absence of an applied electric current. In this embodiment, a boundary 2010 designates the location within golf ball 2000 where inner mantle layer 2006 ends and outer mantle layer 2004 begins. In this embodiment, the outer periphery of inner mantle layer 2006 is in contact with the inner periphery of outer mantle layer 2004 at boundary 2010.

FIG. 21 illustrates an exemplary embodiment of a golf ball 2100 in the presence of an applied electric current. An electric current may be applied to the piezoelectric material any method described herein, including using the internal circuitry and/or external apparatus described above. In this embodiment, golf ball 2100 is comprised substantially similar to golf ball 2000 in the absence of an applied electric current, including cover 2002 and core 2008. In this embodiment, however, the presence of the applied electric current has affected the material properties of the first piezoelectric material in outer mantle layer 2004 and the second piezoelectric material in inner mantle layer 2006.

In one exemplary embodiment, the applied electric current may cause the first piezoelectric material in outer mantle layer 2104 to compress and the second piezoelectric material in inner mantle layer 2106 to expand. As shown in FIG. 21, outer mantle layer 2104 may expand to have a third thickness T3 associated with the first piezoelectric material in the presence of an applied electric current. In this embodiment, third thickness T3 is smaller than first thickness T1. Similarly, inner mantle layer 2106 may compress to have a fourth thickness T4 associated with the second piezoelectric material in the presence of an applied electric current. In this embodiment, fourth thickness T4 is larger than second thickness T2.

In some embodiments, first thickness T1 and second thickness T2 of outer mantle layer 2004 and inner mantle layer 2006, respectively, may be selected to provide golf ball 2000 with a desired diameter in the absence of an applied electric current. Similarly, the first piezoelectric material of outer mantle layer 2104 and the second piezoelectric material of inner mantle layer 2106 may be selected so that the diameter of golf ball 2100 remains substantially similar to golf ball 2000 when in the presence of an applied electric current. In one exemplary embodiment, the sum of first thickness T1 and second thickness T2 in the absence of an applied electric current is substantially equal to the sum of third thickness T3 and fourth thickness T4 in the presence of an applied electric current. With this arrangement, golf ball 2000 in the absence of an applied electric current may retain substantially the same diameter as golf ball 2100 in the presence of an applied electric current.

In some embodiments, the applied electric current to golf ball 2100 may cause internal stress. Internal stress may be caused by opposing forces at boundary 2010. In this embodiment, the expansion of inner mantle layer 2104 and the compression of outer mantle layer 2104 may cause opposing forces at boundary 2010. With this arrangement, the effect of the internal stress inside golf ball 2100 caused by the piezoelectric materials may give golf ball 2100 a larger apparent hardness. The larger apparent hardness may affect the flight characteristics of golf ball 2100 as described above.

In addition to the embodiments described above, a golf ball with piezoelectric material may be used in other systems that make use of the properties of the piezoelectric material. For example, a system and method could measure parameters associated with hitting a golf ball with a piezoelectric material to detect an electrical signal in the piezoelectric material. Hit golf ball data obtained from a golf ball with piezoelectric material according to the present method and system may be used as a component in the golf ball fitting system disclosed in copending and commonly owned U.S. Patent Publication No. 2011/0009215, entitled "Method and System for Golf Ball Fitting Analysis", and filed on Jul. 7, 2009, which is incorporated herein by reference.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A system comprising:

a golf ball including a piezoelectric material layer;

a golf tee including:

an upper surface configured to support the golf ball;

a first contact member and a second contact member, each being respectively disposed on the upper surface;

a power source coupled to each of the first contact member and second contact member;

wherein the power source selectively applies an electric current to the piezoelectric material layer via the first contact member and the second contact member; and wherein the piezoelectric material layer either radially contracts or radially expands in response to the applied electric current.

2. The system according to claim 1, wherein the piezoelectric material layer comprises polyvinylidene fluoride material.

3. The system according to claim 1, wherein the piezoelectric material layer comprises a cover of the golf ball.

4. The system according to claim 1, wherein the golf ball further comprises:

a processor;

an energy storage device; and wherein the processor is adapted to subject the piezoelectric material layer to an electric current for a predetermined period of time.

5. The system according to claim 4, wherein the energy storage device comprises at least one of a battery and a capacitor.

6. The system according to claim 1, further comprising:

a sensor for detecting a swinging motion of a golf club;

a processor in communication with the sensor and the golf tee;

and wherein the processor controls the power source to subject the piezoelectric material layer to the electric current in response to receiving a signal from the sensor detecting the swinging motion of the golf club.

7. The system according to claim 1, wherein a cover of the golf ball comprises a conductive material.

8. The system according to claim 1, wherein the piezoelectric material layer radially contracts in response to the applied electric current; and wherein the radial contraction increases a hardness of the golf ball.

9. The system according to claim 8, wherein the increase in the hardness of the golf ball alters an impact characteristic of the golf ball when struck by a golf club; and wherein the impact characteristic includes at least one of an amount of deformation of the golf ball, a resultant ball speed, and an amount of ball spin.

* * * * *